US005363678A

United States Patent [19]

Meckbach

[11] Patent Number: 5,363,678

[45] Date of Patent: Nov. 15, 1994

[54] PADLOCK WITH BALL-LOCKED SHACKLE

[75] Inventor: Gerhard Meckbach, Hagen, Germany

[73] Assignee: Abus August Bremicker Sohne KG, Volmarstein, Germany

[21] Appl. No.: 46,008

[22] Filed: Apr. 9, 1993

[51] Int. Cl.[5] ..... E05B 67/24

[52] U.S. Cl. ..... 70/38 A; 70/379 R; 70/386; 70/DIG. 42

[58] Field of Search ..... 70/38 A, DIG. 42, 386, 70/DIG. 36, 379 R, 379 A, 380, 389, 371

[56] References Cited

U.S. PATENT DOCUMENTS

| | | | |
|---|---|---|---|
| 1,607,758 | 11/1926 | Junkune | 70/38 A |
| 2,460,615 | 2/1949 | Andrew | 70/386 |
| 3,143,872 | 8/1964 | Check | 70/38 A |
| 4,290,280 | 9/1981 | Yun | 70/38 A |
| 4,593,546 | 6/1986 | Allen | 70/380 |
| 4,938,039 | 7/1990 | Tzung-I | 70/38 A |
| 4,998,422 | 3/1991 | Borgmann et al. | 70/38 A |
| 5,174,136 | 12/1992 | Thwing | 70/379 RX |
| 5,189,893 | 3/1993 | Kortenbrede | 70/386 X |
| 5,193,372 | 3/1993 | Sieg et al. | 70/379 R X |

FOREIGN PATENT DOCUMENTS

| | | | |
|---|---|---|---|
| 970987 | 7/1975 | Canada | 70/38 A |
| 239165 | 8/1969 | U.S.S.R. | 70/38 A |

*Primary Examiner*—Lloyd A. Gall
*Attorney, Agent, or Firm*—Herbert Dubno; Yuri Kateshov

[57] ABSTRACT

A padlock having a key-rotated cylinder with an end face juxtaposed with an end face of a pin rotatable in a padlock body to release a pair of balls held by the pin in notches in shanks of a shackle and wherein the end faces having entraining formations enabling rotation of the cylinder to rotate the pin. One end face has a pair of entrainer posts disposed diametrically opposite one another and offset from a center of a respective end face and reaching toward the other end face, the posts of one of the end faces being angularly offset from the posts of the other end face to define the angular play between them, and a bridge between the posts and disposed on the end face of the cylinder for taking up the play.

6 Claims, 2 Drawing Sheets

PADLOCK WITH BALL-LOCKED SHACKLE

FIELD OF THE INVENTION

My present invention relates to a padlock and, more particularly, to a padlock of the type in which rotation of a cylinder within a padlock body can entrain a rotatable pin to displace a pair of balls outwardly into the notches of shanks of a shackle of the padlock to lock the shackle to the body and, in an unlocked position of the cylinder, to allow the balls to withdraw from the notches sufficiently to permit the shackle to pull at least partly out of the body and thereby open the lock. More particularly, the invention relates to an improvement in a lock of this type which utilize a bridge member taking up angular play between the end face of the cylinder and the rotatable pin.

BACKGROUND OF THE INVENTION

In the ABUS Padlocks and Security Products Catalog 101, pages 5 through 8, see especially page 7, a padlock of the aforedescribed type has been illustrated.

Such a lock generally comprises a lock body and a shackle having a pair of shanks connected by a bight, and receivable in this body. Locking means are, of course, provided in the body to engage the shackle and can be released by a cylinder rotatable by a key and extending into the body from its opposite side.

More particularly, the lock body can have a pair of bores opening at one end face of the body, a longer one of these bores receiving a longer shank of the shackle and a shorter one of the bores receiving the shorter shank of the body.

Close to this face of the body, the latter can be formed with a transverse bore which can have the same diameter of the shackle bores and which opens into the shackle bores and can terminate in a constriction at the short shackle bore.

As part of the locking mechanism for the shackle, a pair of balls can be received in the transverse bore and both of the shackles can have transverse grooves or notches turned toward the transverse bore to enable the balls to engage in these notches in the locked position of the shackle.

In addition, the longer shank of the shackle can have a flat extending from its notch in the direction of its free end and which is shallower than the depth of the notch. This allows, with the respective ball extending partly into the longer bore, the shackle to be pulled out of the lock body by a distance corresponding substantially to the length of that axially extending flat. The latter can terminate in a circumferential groove into which the ball can engage to permit free rotation of the long shank in its outer position with the ball engaging therein. The depth of this groove can correspond to the depth of the flat and the free end of the long shank can be a cylinder stop free from axially extending grooves and channels.

The lock body is formed as well with a pair of parallel offset bores receiving a lock cylinder having the general cross section of a FIG. 8 and opening at the opposite end face of the body. Of these bores, the central bore is longer than the other bore and reaches substantially to the transverse bore within the lock body. The offset shorter bore terminates substantially at the blind end of the shorter shank bore so that a screw passing through the bottom of the latter can engage the cylinder and hold the same in place.

In the longer central bore, a cylindrical pin is provided substantially at the intersection of this longer bore with the transverse bore and is rotatable in the longer central bore.

The pin has two opposite axially directed grooves with cylindrical surfaces to receive in part the two balls mentioned previously. One smooth end of the pin rests against the bottom of the longer central bore while the other end face is formed with at least one entraining formation which cooperates with a corresponding entrainer on the juxtaposed end face of the cylinder inserted into that central bore.

When a key is inserted into the cylinder, the latter can be rotated from its locking position or closed position into the open position whereby the entrainer of the cylinder engages the entrainer of the pin and rotates the pin into a position in which the grooves thereof are oriented in line with the transverse bore and the balls can be partly received in these grooves. In this position, the balls are cammed into the grooves of the post from the respective notches of the shanks of the shackle and the shackle can be unlocked. The key can rotate the cylinder in the opposite direction without rotation of the pin and entrainment thereby of the cylinder while one ball disposed between the respective groove of the pin and the flat or the circumferential groove of the longer shank prevents rotation of the pin. Rotation of the pin is therefore permitted again only after the shackle has been fully inserted into its locked position.

A coil spring under the long shank can bias the shackle into its open position.

The pin itself may be biased angularly by a spring so that the displacement of the pin from the locking position into the open position can be effected by this spring.

When a lock provided with such spring is opened by rotation of the key, the shackle springs out by the expansion of the spring below the longer shackle shank.

With a commercially available lock of this type, there is no so-called locking force which could cause the cylinder to return from the open position to the closed position and enable the key to be withdrawn. This is a result of angular play between the entrainers of the pin and the cylinder which allows a return rotation of the cylinder without a forced rotation of the pin.

This can be disadvantageous in many cases since it makes it possible for the user to rotate the cylinder manually into the closed position and withdraw the key without the necessity of closing the lock, i.e. force the shackle back into its locking position. The user can then forget that the padlock has not been locked and may assume that it has been locked because he or she is in possession of the key.

In many cases, it is desirable and, indeed, essential to provide a padlock of this type so that it has forced locking and enables the key to be withdrawn only when the shackle has been returned to its locking position. Such a force locking function is frequently referred to as "key retaining" because it is associated with the inability to withdraw the key unless the shackle is closed.

There are, of course, locks in which such forced locking occurs but such locks are frequently relatively complicated and cannot be used as so-called automatic locks without forced locking as the user may desire.

OBJECTS OF THE INVENTION

It is therefore an object of the present invention to provide an improved padlock which can be used selectively as a so-called automatic lock without forced locking or, if desired, as a key-retaining lock with forced locking.

Another object of this invention is to provide an improved padlock with all of the advantages of the padlock described and of similar low cost construction but which can be equipped for use selectively as a key-retaining or forced locking lock and as an automatic lock without forced locking.

SUMMARY OF THE INVENTION

These objects and others which will become more readily apparent hereinafter are attained, in accordance with this invention, by providing a bridge member or insert, readily removable from and insertable between the end faces of the cylinder and the pin and which takes up the angular play between the entrainers of the pin and the cylinder and allows rotation of the lock cylinder only with simultaneous rotation of the pin.

More specifically, a padlock according to the invention can comprise:

a lock body;

a shackle having a pair of shanks connected by a bight, one of the shanks being longer than another of the shanks, the body having a long bore opening at a surface of the body adapted to receive the one of the shanks, a short bore opening at the surface and adapted to receive the other of the shanks, and a transverse bore of substantially the same diameter as the short bore in a region of a mouth thereof at the surface and opening with a constriction into the short bore;

respective notches formed in the shanks and lying within the long and short bores upon locking of the shackle;

a ball received in the transverse bore and partly passing partly through the constriction to engage in the notch of the other of the shanks and a ball received in the transverse bore and engageable with the notch in the one of the shanks, the one of the shanks having an axially extending flat running from its respective notch away from the bight and of a depth less than that of the notch of the one of the shanks;

a longer central bore and a shorter offset bore formed in the body parallel to one another and opening at a surface of the body opposite the surface at which the long and short bores open, the central and offset bores together forming a receiving chamber having generally a figure-eight cross section;

a lock cylinder removably received in the receiving chamber and having a generally figure-eight cross section corresponding thereto, the central bore reaching to the transverse bore and the offset bore reaching almost to a bottom of the short bore, the bottom being formed with a hole receiving a screw threadedly engaging the lock cylinder for retaining the lock cylinder in the chamber, the screw being removable through the short bore upon withdrawal of the one of the shanks therefrom;

a cylindrical pin received in an end of the central bore and extending into the transverse bore, the central pin having a pair of oppositely disposed concavities respectively receiving the balls upon displacement thereof by the shanks out of the long and short bores and being rotatable to retain the balls in the notches and prevent withdrawal of the shackle from the body, the pin having an end face turned toward the cylinder and formed with at least one entrainer post positioned to engage an entrainer post on the cylinder rotatable by insertion of a key into the cylinder, whereby the shackle is locked and unlocked, the one of the shanks preventing escape of the respective ball from one of the concavities in an unlocked position of the shackle, thereby preventing free rotation of the pin in the unlocked position and permitting pin rotation only while the other shank is received in the short bore, the entrainer posts on the cylinder and the pin having an angular play between them; and a play-takeup bridge inserted between the entrainer posts of the cylinder and the pin and disposed between the end face of the pin and an end face of the cylinder juxtaposed with the end face of the cylinder as a separate piece from the pin and the cylinder and enabling rotation of the cylinder only with simultaneous rotation of the pin.

In a more general sense the invention can comprise, in a padlock which has a pair of balls held by said pin in notches in shanks of a shackle and wherein said end faces have entraining formations enabling rotation of said cylinder to rotate said pin, the improvement wherein:

each of the end faces has a pair of entrainer posts disposed diametrically opposite one another and offset from a center of a respective end face and reaching toward the other end face, the posts of one of the end faces being angularly offset from the posts of the other end face to define the angular play between them, and a bridge between the posts and disposed on the end face of said cylinder for taking up the play.

By providing the bridge member, shim or spacer between the entraining members of, for example, the automatic lock described above, I can transform that lock into a forced locking or key retaining lock enabling the key to be removed only when the shackle is in its locked position.

The cost of the means required for this conversion, i.e. the bridge members, is extremely small and the method of converting the automatic lock without forced closure to the forced closure lock and vice versa requires release of the aforementioned screw in the unlocked position, withdrawal of the cylinder, placing the insert on the end face of the cylinder and reinserting the cylinder and tightening the screw. This approach is simplified by the fact that in the open position, the pin is held in place by the ball engaging the longer shank of the shackle.

According to a feature of the invention, the end face of the pin is formed with two of the entrainer posts disposed off-center and diametrically opposite one another on the pin and with a radial spacing from one another at least equal to a radial spacing of a respective pair of entrainer posts on the end face of the cylinder, the posts of the end faces defining an angular play between them corresponding to rotation of the cylinder from an open to a closed position of the cylinder, the bridge being a substantially Z-shaped insert on the end face of the cylinder filling the angular free space in a radial direction between the entrainer posts of the pin and the cylinder.

Alternatively, the end face of the pin is formed with two of the entrainer posts disposed off-center and diametrically opposite one another on the pin and with a radial spacing from one another at least equal to a radial spacing of a respective pair of entrainer posts on the end face of the cylinder, the posts of the end faces defining an angular play between them corresponding to rotation of the cylinder from an open to a closed position of the cylinder, the bridge being a disk formed with openings respectively receiving each of the entrainer posts of the pin and the cylinder and disposed on the end face of the cylinder filling angular free space in a radial direction between the entrainer posts of the pin and the cylinder.

The use of a z-shaped insert has been found to provide a rapid and accurate changeover, while the use of a disk can be similarly effective. When a disk is used, moreover, the versatility of the system can be increased, since each entrainer can be engaged in a complementary hole in the disk. As a con-sequence, the end face of the cylinder can have only one entrainer post while the pin can have only two entrainer posts or one. The use of a circular disk with corresponding holes for the post enables the disk, although an insert and a removable part, to form a quasirigid connection between the entrainers.

According to a further feature of the invention, the insert can be a pin, rod or the like engaging in matching recesses of the cylinder end face and the pin end face, whereby the pin or the like as well as the matching recesses can be arranged eccentrically with respect to the end faces.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
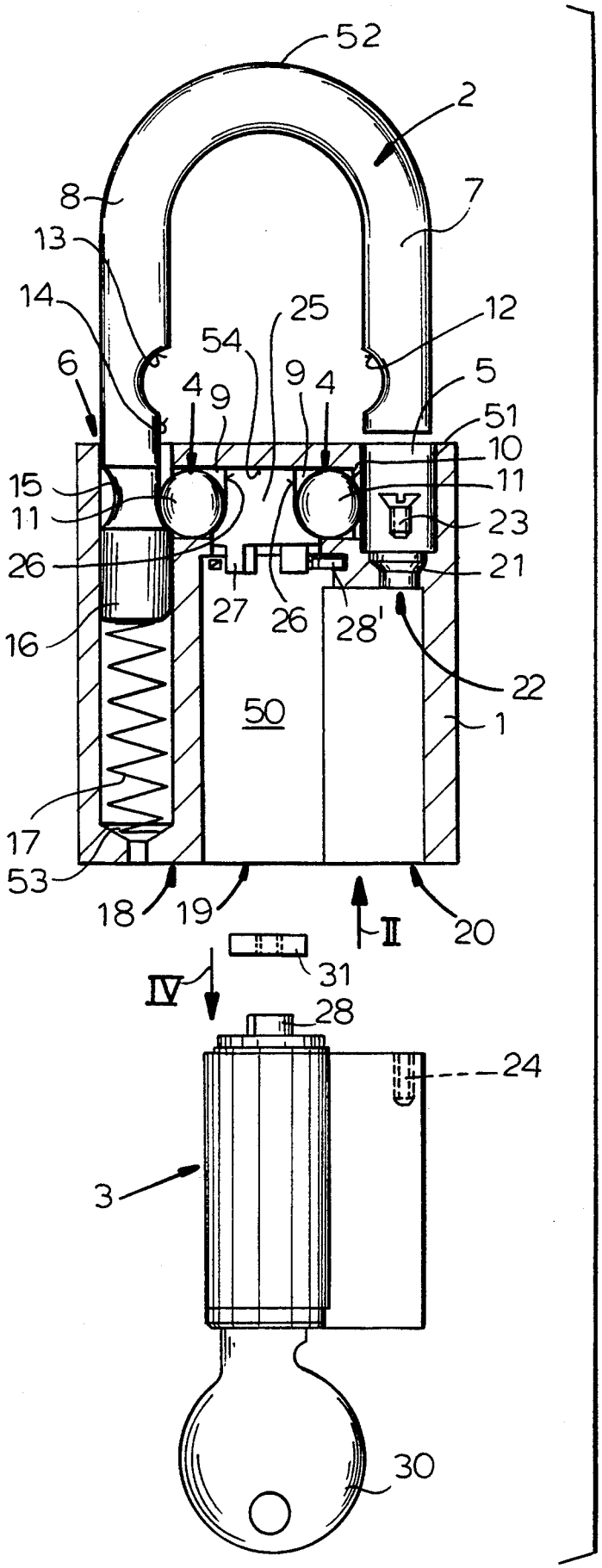
FIG. 1 is an exploded view, partly in cross section, illustrating a padlock according to the invention.
Figure 2:
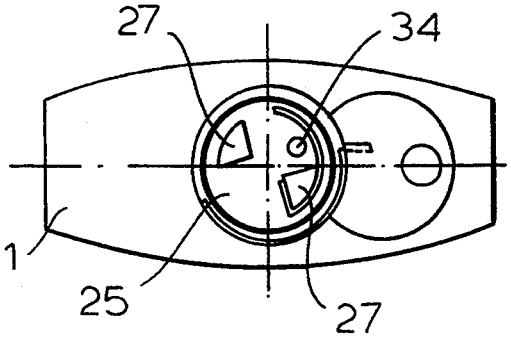
FIG. 2 is an end view of the lock body taken in the direction of the arrow II in FIG. 1.

FIG. 1 shows a padlock which comprises a lock body, a lock shackle 2 and a lock cylinder 3 of FIG. 8 configuration receivable in a chamber 50 in the lock body. The lock mechanism is represented as a whole at 4.

At one end face 51 of the lock body 1 (the upper end face in FIG. 1), two bores 5 and 6 open to receive the shanks 7 and 8 of the shackle 2. The shanks 7 and 8 are connected by a bight 52.

One of the bores 6 is longer than the other bore 5 and receives the longer shank 8. The shorter bore 5 receives the shorter shank 7. Close to the end face 51 and the mouths of the bores 5 and 6, a transverse bore 9 is provided in the body 1. The transverse bore 9 runs from the bore 6 to shortly before the bore 5 to open into the latter with a constriction 10 which prevents the ball 11 from falling into the shorter bore 5. The transverse bore 9 is of the same diameter as the bores 5 and 6.

In the regions of the transverse bore 9 at which it opens into the bores 5 and 6, locking elements in the form of balls 11 are provided.

The shorter shank 7 has a transverse groove 12 to receive one of the balls 11 while the longer shank 8 has a transverse groove 13 to receive part of the other ball 11 at the same level as the transverse groove 12, the grooves 12 and 13 also being referred to herein as notches.

The flank of the groove 13 located toward the free end of the shank 8 and away from the bight 52 extends into an axially extending flat 14 which is shallower than the depth of the transverse groove 13 but can correspond in depth to an annular groove 15 between the flat 14 and the cylinder free end portion 16 of the shank 8. This flat abuts the ball 11 and prevents it from falling out of its transverse bore 9, while insuring that, by cooperation with the ball 11, the shackle 2 can be pulled partly out of the body I to enable the short shank 7 to clear the end face 51.

The groove 15 forms a stop for the shackle 2 preventing its withdrawal from the body 1.

Between the bottom of the cylindrical portion 16 of the long shank 8 and the body 1, a coil spring 17 is provided to bias the shackle into its open position.

The coil spring is braced against the bottom 53 of the long bore 6 previously mentioned.

The lock body is also formed with a central long bore 19 and an eccentric bore 20 parallel thereto and opening at the end face 18 which is opposite the face 51 and together forming the chamber 50 previously mentioned.

The longer central bore 19 reaches through the transverse bore 9 to a bottom 54 of the transverse bore 9. The offset bore 20 is shorter and extends to a location below the bottom 21 of the bore 5 for the shorter shank 7.

The bottom 21 is formed with a hole 22 through which a headed screw 23 can be inserted or removed when the lock is open and the shank 7 withdrawn. The screw 23 can engage in a threaded bore 24 of the lock cylinder 3 to secure the latter in the lock housing or body 1. This screw is, as noted, only accessible when the lock shackle is in its open position.

The chamber 50 formed by the bores 19 and 20 is of FIG. 8 cross section to accommodate the lock cylinder 3 which is of corresponding cross section.

In the intersection between the longer bore 19 and the transverse 9, a cylindrical pin 25 is received. This pin has 2 axially directed grooves 26, one of which is deeper than the other, to accommodate parts of the balls 11 when the pin 25 is rotated about the axis of the bore 19 to axially align the grooves 26 with the transverse bore 9.

The smooth end face of the pin 25 facing away from the cylinder 3 lies against the bottom 54 of the bore 19 at the top in FIG. 1, while the other end face of the pin has two entraining posts 27.

The pin 25 is held in the housing by a spiral spring 28′ preventing the pin from falling out of the transverse groove 9. The spring 28′ is stressed in a closed position of the pin 25 in which the balls 11 are aligned with the grooves 26 of the pin defining thereby an open position of the lock in which the shackle can be removed from the bore 5.

The entrainer post 27 cooperates with entraining post 28 on the juxtaposed end face 29 of the cylinder 3 upon its insertion in the bore 19.

The end face 29 of the cylinder formed with the posts 28 is rotated by the key 30. The key 30 may be any conventional bitted key and can rotate the end face 29 only when its bitting matches the tumblers of the cylinder as is known.

Upon insertion of the key 30 into the key slit of the cylinder 3 and rotation of the key from the locking position of the cylinder into the open position thereof, the entrainer posts 28 of the cylinder 3 engage the entrainer posts 27 of the pin 25 and rotate the pin into the closed position of the pin shown in FIG. 1.

In this position, the balls 11 are aligned with the grooves 26 so that the balls can partially pass into these grooves and can withdraw from the notches 12 and 13.

Complete removal of the shackle is prevented by the fact that the flat 14 rides along the respective ball 11 and the lower flank of the groove 15 can engage this ball to form a stop by which the thicker end 16 of the shackle can not be withdrawn.

The shackle 2 is free to rotate about the axis of the longer shank 8. (For assembly or replacement of parts, if necessary, after the spiral spring has been removed, the pin 25 can be rotated into a position in which the deeper groove 26 is aligned with the ball-juxtaposed with the longer shank to allow the end 16 to clear the ball).

The automatic return rotation of the pin 25 into an open position thereof corresponding to the closed position of the lock with the shackle's notches 12 and 13 engaged by the respective balls by the spiral spring 28' is prevented since the ball 11 on the left in FIG. 1 is engaged by the flat 14.

In the automatic version of the lock, without any bridge between the entraining posts 27, 28, the key 30 can be rotated to its closed position without entraining the pin 25 to allow the key to be withdrawn. When, after the key has been withdrawn, therefore, the shackle 2 is pressed into its closed position against the spring 17, the pin 25 will be rotated by spring 28' into the open position and the balls locked in place in the notches 12 and 13.

Figure 3:
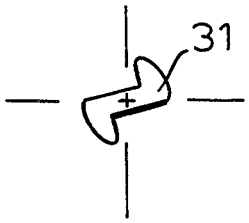
FIG. 3 is an elevational view of the insert or bridge (see from above in FIG. 1)
Figure 5:
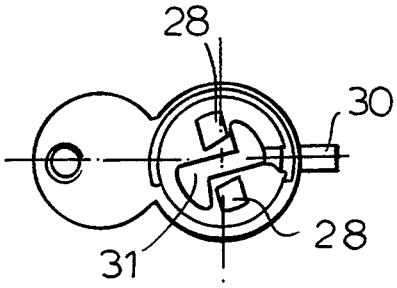
FIG. 5 is a view similar to that of FIG. 4 but with the insert in place.

When, however, the lock is a key retaining or forced closure lock, an insert 31, as shown, for example, in FIGS. 3 and 5, can be placed on the end face of the cylinder 3 and between the end faces of the cylinder 3 and the pin 25 so that the rotation of the cylinder 3 can only occur with simultaneous rotation of the pin 25. As a consequence, the key can then not be withdrawn from the lock cylinder until the pin 25 is in its open position to block withdrawal of the shackle.

In the embodiments of FIGS. 1 through 6, the entrainers on the post 25 are two diametrically opposite segments 27 whose radial spacing is at least equal to that of two posts 28 of the cylinder 3. The posts are dimensioned and positioned so that the angular play of the cylinder is sufficient to allow the cylinder to be rotated from its open position to its closed position.

The insert or bridge 31 is, in FIGS. 1 to 5, z-shaped and disposed simply between the posts 28 as can be seen from FIG. 5.

Figure 6:
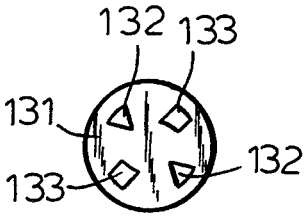
FIG. 6 is a view similar to FIG. 3 of a disk serving as the bridge member or insert in place of the z-shaped insert of FIG. 3 in an alternative embodiment.
Figure 4:
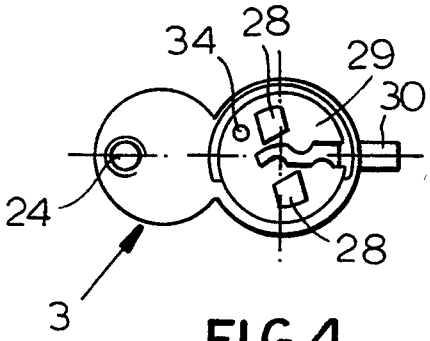
FIG. 4 is an end view of the cylinder with a key fitted therein and taken in the direction of the arrow IV of FIG. 1.
Figure 7:
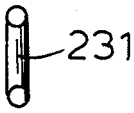
FIG. 7 is a view of a rod or pin serving as an insert or bridge member and which can be fitted into a bore in each of the end faces, the bore being represented diagrammatically in FIG. 4.

Alternatively, the insert can be a disk as shown at 131 in FIG. 6 and can have openings 132 and 133 which are dimensioned and shaped to receive the post 27 and the post 28 respectively. The disk bridge member 131, therefore, provides a practically rigid connection between the cylinder and the pin.

It is also possible to provide an eccentric pin 231 which can fit into a hole 34 in the end face of the cylinder 3 and a corresponding hole in the end face of the pin to serve a similar purpose.

The invention is not limited to the embodiments described and illustrated and, of course, includes all of the features described individually and in combination as may be within the scope and spirit of the appended claims.

I claim:

1. A padlock having a key-rotated cylinder with an end face juxtaposed with an end face of a pin rotatable in a padlock body to release a pair of balls held by said pin in notches in shanks of a shackle and wherein said end faces having entraining formations enabling rotation of said cylinder to rotate said pin, the improvement wherein:

each of said end faces has, as said formations, a pair of entrainer posts disposed diametrically opposite one another and offset from a center of a respective end face and reaching toward the other end face, said posts of one of said end faces being angularly offset from the posts of the other end face to define an angular play between them, and a bridge provided as a z-shaped member between the posts and disposed on the end face of said cylinder for taking up said play.

2. A padlock having a key-rotated cylinder with an end face juxtaposed with an end face of a pin rotatable in a padlock body to release a pair of balls held by said pin in notches in shanks of a shackle and wherein said end faces having entraining formations enabling rotation of said cylinder to rotate said pin, the improvement wherein:

each of said end faces has, as said formations, a pair of entrainer posts disposed diametrically opposite one another and offset from a center of a respective end face and reaching toward the other end face, said posts of one of said end faces being angularly offset from the posts of the other end face to define an angular play between them, and a bridge between the posts and disposed on the end face of said cylinder for taking up said play, said bridge being provided as a disk having openings receiving said posts and complementary thereto.

3. A padlock, comprising:

a lock body;

a shackle having a pair of shanks connected by a bight, one of said shanks being longer than another of said shanks, said body having a long bore opening at a surface of said body adapted to receive said one of said shanks, a short bore opening at said surface and adapted to receive said other of said shanks, and a transverse bore of substantially the same diameter as said short bore in a region of a mouth thereof at said surface and opening with a constriction into said short bore;

respective notches formed in said shanks and lying within said long and short bores upon locking of said shackle;

a ball received in said transverse bore and passing partly through said constriction to engage in said notch of said other of said shanks and a ball received in said transverse bore and engageable with said notch in said one of said shanks, said one of said shanks having an axially extending flat running from its respective notch away from said bight and of a depth less than that of the notch of said one of said shanks;

a longer central bore and a shorter offset bore formed in said body parallel to one another and opening at a surface of said body opposite the surface at which said long and short bores open, said central and offset bores together forming a receiving chamber having generally a figure-eight cross section;

a lock cylinder removably received in said receiving chamber and having a generally figure-eight cross section corresponding thereto, said central bore reaching to said transverse bore and said offset bore reaching almost to a bottom of said short bore, said bottom being formed with a hole receiving a screw threadedly engaging said lock cylinder for retaining said lock cylinder in said chamber, said screw being removable through said short bore upon withdrawal of said other of said shanks therefrom;

a cylindrical pin received in an end of said central bore and extending into said transverse bore, said cylindrical pin having a pair of oppositely disposed concavities respectively receiving said balls upon displacement thereof by said shanks out of said long and short bores and being rotatable to retain said balls in said notches and prevent withdrawal of said shackle from said body, said pin having an end face turned toward said cylinder and formed with at least one entrainer post positioned to engage an entrainer post on said cylinder rotatable by insertion of a key into said cylinder, whereby said shackle is locked and unlocked, said one of said shanks preventing escape of the respective ball from one of said concavities in an unlocked position of said shackle, thereby preventing free rotation of said pin in said unlocked position and permitting pin rotation only while said other shank is received in said short bore, said entrainer posts on said cylinder and said pin having an angular play between them; and a play-takeup bridge inserted between said entrainer posts of said cylinder and said pin and disposed between said end face of said pin and an end face of said cylinder juxtaposed with said end face of said cylinder as a separate piece from said pin and said cylinder and enabling rotation of said cylinder only with simultaneous rotation of said pin, said end face of said pin being formed with two of said entrainer posts disposed off-center and diametrically opposite one another on said pin and with a radial spacing from one another at least equal to a radial spacing of a respective pair of entrainer posts on said end face of said cylinder, said posts of said end faces defining an angular play between them corresponding to rotation of said cylinder from an open to a closed position of the cylinder, said bridge being a substantially Z-shaped insert on said end face of said cylinder filling angular free space in a radial direction between said entrainer posts of said pin and said cylinder.

4. A padlock, comprising:

a lock body;

a shackle having a pair of shanks connected by a bight, one of said shanks being longer than another of said shanks, said body having a long bore opening at a surface of said body adapted to receive said one of said shanks, a short bore opening at said surface and adapted to receive said other of said shanks, and a transverse bore of substantially the same diameter as said short bore in a region of a mouth thereof at said surface and opening with a constriction into said short bore;

respective notches formed in said shanks and lying within said long and short bores upon locking of said shackle;

a ball received in said transverse bore and passing partly through said constriction to engage in said notch of said other of said shanks and a ball received in said transverse bore and engageable with said notch in said one of said shanks, said one of said shanks having an axially extending flat running from its respective notch away from said bight and of a depth less than that of the notch of said one of said shanks;

a longer central bore and a shorter offset bore formed in said body parallel to one another and opening at a surface of said body opposite the surface at which said long and short bores open, said central and offset bores together forming a receiving chamber having generally a figure-eight cross section;

a lock cylinder removably received in said receiving chamber and having a generally figure-eight cross section corresponding thereto, said central bore reaching to said transverse bore and said offset bore reaching almost to a bottom of said short bore, said bottom being formed with a hole receiving a screw threadedly engaging said lock cylinder for retaining said lock cylinder in said chamber, said screw being removable through said short bore upon withdrawal of said other of said shanks therefrom;

a cylindrical pin received in an end of said central bore and extending into said transverse bore, said cylindrical pin having a pair of oppositely disposed concavities respectively receiving said balls upon displacement thereof by said shanks out of said long and short bores and being rotatable to retain said balls in said notches and prevent withdrawal of said shackle from said body, said pin having an end face turned toward said cylinder and formed with at least two formations disposed off-center and diametrically opposite one another on said pin and with a radial spacing from one another at least equal to a radial spacing of a respective pair of entrainer formations on said end face of said cylinder, said formations of said end faces defining an angular play between them corresponding to rotation of said cylinder from an open to a closed position of the cylinder by insertion of a key into said cylinder, whereby said shackle is locked and unlocked, said one of said shanks preventing escape of the respective ball from one of said concavities in an unlocked position of said shackle, thereby preventing free rotation of said pin in said unlocked position and permitting pin rotation only while said other shank is received in said short bore; and a play-takeup bridge inserted between said entrainer formations of said cylinder and said pin and disposed between said end face of said pin and an end face of said cylinder juxtaposed with said end face of said cylinder as a separate piece from said pin and said cylinder and enabling rotation of said cylinder only with simultaneous rotation of said pin, said bridge being a substantially Z-shaped insert on said end face of said cylinder filling angular free space in a radial direction between said entrainer formations of said pin and said cylinder.

5. A padlock, comprising:

a lock body;

a shackle having a pair of shanks connected by a bight, one of said shanks being longer than another of said shanks, said body having a long bore opening at a surface of said body adapted to receive said one of said shanks, a short bore opening at said surface and adapted to receive said other of said shanks, and a transverse bore of substantially the same diameter as said short bore in a region of a mouth thereof at said surface and opening with a constriction into said short bore;

respective notches formed in said shanks and lying within said long and short bores upon locking of said shackle;

a ball received in said transverse bore and passing partly through said constriction to engage in said notch of said other of said shanks and a ball received in said transverse bore and engageable with said notch in said one of said shanks, said one of said shanks having an axially extending flat running from its respective notch away from said bight and of a depth less than that of the notch of said one of said shanks;

a longer central bore and a shorter offset bore formed in said body parallel to one another and opening at a surface of said body opposite the surface at which said long and short bores open, said central and offset bores together forming a receiving chamber having generally a figure-eight cross section;

a lock cylinder removably received in said receiving chamber and having a generally figure-eight cross section corresponding thereto, said central bore reaching to said transverse bore and said offset bore reaching almost to a bottom of said short bore, said bottom being formed with a hole receiving a screw threadedly engaging said lock cylinder for retaining said lock cylinder in said chamber, said screw being removable through said short bore upon withdrawal of said other of said shanks therefrom;

a cylindrical pin received in an end of said central bore and extending into said transverse bore, said cylindrical pin having a pair of oppositely disposed concavities respectively receiving said balls upon displacement thereof by said shanks out of said long and short bores and being rotatable to retain said balls in said notches and prevent withdrawal of said shackle from said body, said pin having an end face turned toward said cylinder and formed with a respective pair of entrainer posts, said posts being disposed off-center and diametrically opposite one another on said pin and with a radial spacing from one another at least equal to a radial spacing of a respective pair of entrainer posts on an end face of said cylinder, said posts of said end faces defining an angular play between them corresponding to rotation of said cylinder by insertion of a key into said cylinder from an open to a closed position of the cylinder, whereby said shackle is locked and unlocked, said one of said shanks preventing escape of the respective ball from one of said concavities in an unlocked position of said shackle, thereby preventing free rotation of said pin in said unlocked position and permitting pin rotation only while said other shank is received in said short bore; and a play-takeup bridge inserted between said entrainer posts of said cylinder and said pin and disposed between said end face of said pin and said end face of said cylinder juxtaposed with said end face of said cylinder as a separate piece from said pin and said cylinder and enabling rotation of said cylinder only with simultaneous rotation of said pin, said bridge being a disk formed with openings respectively receiving each of said entrainer posts of said pin and said cylinder and disposed on said end face of said cylinder filling angular free space in a radial direction between said entrainer posts of said pin and said cylinder.

6. A padlock, comprising:

a lock body;

a shackle having a pair of shanks connected by a bight, one of said shanks being longer than another of said shanks, said body having a long bore opening at a surface of said body adapted to receive said one of said shanks, a short bore opening at said surface and adapted to receive said other of said shanks, and a transverse bore of substantially the same diameter as said short bore in a region of a mouth thereof at said surface and opening with a constriction into said short bore;

respective notches formed in said shanks and lying within said long and short bores upon locking of said shackle;

a ball received in said transverse bore and passing partly through said constriction to engage in said notch of said other of said shanks and a ball received in said transverse bore and engageable with said notch in said one of said shanks, said one of said shanks having an axially extending flat running from its respective notch away from said bight and of a depth less than that of the notch of said one of said shanks;

a longer central bore and a shorter offset bore formed in said body parallel to one another and opening at a surface of said body opposite the surface at which said long and short bores open, said central and offset bores together forming a receiving chamber having generally a figure-eight cross section;

a lock cylinder removably received in said receiving chamber and having a generally figure-eight cross section corresponding thereto, said central bore reaching to said transverse bore and said offset bore reaching almost to a bottom of said short bore, said bottom being formed with a hole receiving a screw threadedly engaging said lock cylinder for retaining said lock cylinder in said chamber, said screw being removable through said short bore upon withdrawal of said other of said shanks therefrom;

a cylindrical pin received in an end of said central bore and extending into said transverse bore, said cylindrical pin having a pair of oppositely disposed concavities respectively receiving said balls upon displacement thereof by said shanks out of said long and short bores and being rotatable to retain said balls in said notches and prevent withdrawal of said shackle from said body, said pin having an end face turned toward said cylinder and formed with at least two formations disposed off-center and diametrically opposite one another on said pin and with a radial spacing from one another at least equal to a radial spacing of a respective pair of entrainer formations on an end face of said cylinder, said formations of said end faces defining an angular play between them corresponding to rotation of said cylinder from an open to a closed position of the cylinder by insertion of a key into said cylinder, whereby said shackle is locked and unlocked, said one of said shanks preventing escape of the respective ball from one of said concavities in an unlocked position of said shackle, thereby preventing free rotation of said pin in said unlocked position and permitting pin rotation only while said other shank is received in said short bore; and a play-takeup bridge inserted between said formations of said cylinder and said pin and disposed between said end face of said pin and said end face of said cylinder juxtaposed with said end face of said cylinder as a separate piece from said pin and said cylinder and enabling rotation of said cylinder only with simultaneous rotation of said pin, said bridge being a disk formed with openings respectively receiving each of said formations of said pin and the cylinder and disposed on said end face of said cylinder filling angular free space in a radial direction between said formations of said pin and said cylinder.

* * * * *